US009596941B1

(12) United States Patent
Romero

(10) Patent No.: US 9,596,941 B1
(45) Date of Patent: Mar. 21, 2017

(54) CHAIR BACK WITH HEIGHT AND LUMBAR ADJUSTMENT

(71) Applicant: Office Master, Ontario, CA (US)

(72) Inventor: Francisco Romero, Los Angeles, CA (US)

(73) Assignee: Office Master Inc., Ontario, CA (US)

( * ) Notice: Subject to any disclaimer, the term of this patent is extended or adjusted under 35 U.S.C. 154(b) by 0 days.

(21) Appl. No.: 15/012,956

(22) Filed: Feb. 2, 2016

(51) Int. Cl.
*A47C 3/026* (2006.01)
*A47C 7/46* (2006.01)

(52) U.S. Cl.
CPC ..... *A47C 7/462* (2013.01); *A47C 7/465* (2013.01)

(58) Field of Classification Search
CPC ..... A47C 7/462; A47C 7/465
USPC ..... 297/284.4, 284.7, 353
See application file for complete search history.

(56) References Cited

U.S. PATENT DOCUMENTS 4,632,454 A * 12/1986 Naert ..... B60N 2/66 297/284.4
4,834,455 A * 5/1989 Proctor ..... B60N 2/643 297/284.7
4,930,840 A * 6/1990 Tornero ..... A47C 7/44 297/353
4,993,164 A * 2/1991 Jacobsen ..... A47C 31/126 297/284.4
5,100,200 A * 3/1992 Keusch ..... A47C 1/03238 297/353 X
5,174,526 A 12/1992 Kanigowski
5,193,880 A * 3/1993 Keusch ..... A47C 1/03255 297/353 X
5,582,460 A * 12/1996 Schultz ..... A47C 7/402 297/353
5,630,650 A * 5/1997 Peterson ..... A47C 7/402 297/353 X
5,791,733 A * 8/1998 van Hekken ..... A47C 7/465 297/284.4
5,975,632 A * 11/1999 Ginat ..... A47C 7/462 297/284.4
6,189,972 B1 * 2/2001 Chu ..... A47C 7/465 297/284.4
6,260,921 B1 7/2001 Chu et al.
6,309,018 B1 10/2001 Jernstrom
6,378,942 B1 * 4/2002 Chu ..... A47C 7/462 297/284.4

(Continued)

*Primary Examiner* — Rodney B White
(74) *Attorney, Agent, or Firm* — Andrus Intellectual Property Law, LLP

(57) ABSTRACT

An office chair including a chair back assembly that is independently adjustable to adjust the vertical height of the chair back and to provide lumbar support. The chair back assembly includes a flexible back shell that is movable vertically along a back support yoke. The vertical movement of the flexible back shell adjusts the vertical height of the chair back assembly relative to the seat. The chair back assembly further includes a lumbar adjustment mechanism having an adjustment cable connected to a bottom end of the flexible back shell. Operation of the lumbar adjustment mechanism moves the bottom end of the flexible back shell vertically within a pair of spaced lower movement slots. The movement of the bottom end of the flexible back shell increases the amount that the flexible back shell protrudes from the back support yoke, thereby increasing the lumbar support.

20 Claims, 13 Drawing Sheets

(56) References Cited

U.S. PATENT DOCUMENTS 6,382,719 B1 * 5/2002 Heidmann ..... A47C 7/46 297/284.4 X
6,419,318 B1 * 7/2002 Albright ..... A47C 7/462 297/284.4
6,471,294 B1 * 10/2002 Dammermann ..... A47C 7/24 297/284.4
6,616,228 B2 9/2003 Heidmann
6,755,467 B1 6/2004 Chu
6,805,405 B2 10/2004 Koo
7,080,885 B2 * 7/2006 Bain ..... A47C 1/03 297/353
7,216,933 B2 5/2007 Schmidt et al.
7,216,936 B2 * 5/2007 Peterson ..... A47C 7/24 297/284.4
7,874,619 B2 1/2011 Harley
8,162,399 B2 4/2012 Demontis et al.
8,235,467 B2 8/2012 Akutsu
8,251,448 B2 8/2012 Machael et al.
8,579,376 B2 * 11/2013 Chen ..... A47C 7/402 297/353
8,668,266 B2 3/2014 Jaranson et al.
8,690,249 B2 * 4/2014 Kang ..... A47C 7/402 297/353
2002/0195853 A1 * 12/2002 Heidmann ..... A47C 7/462 297/284.4
2004/0124679 A1 * 7/2004 Teppo ..... A47C 7/465 297/284.4
2005/0179290 A1 * 8/2005 Hancock ..... B60N 2/0228 297/284.4
2005/0275263 A1 * 12/2005 Norman ..... A47C 7/46 297/284.4
2005/0275264 A1 * 12/2005 Norman ..... A47C 7/46 297/284.4
2008/0296945 A1 * 12/2008 Bedford ..... A47C 7/40 297/284.4
2009/0115235 A1 * 5/2009 Bock ..... A47C 7/462 297/284.7
2009/0146476 A1 * 6/2009 Kan ..... A47C 1/03255 297/284.4
2011/0215623 A1 * 9/2011 Tsai ..... A47C 7/402 297/353 X
2011/0298260 A1 * 12/2011 Hsuan-Chin ..... A47C 7/46 297/284.7
2013/0154314 A1 6/2013 Romero
2014/0077548 A1 * 3/2014 Peterson ..... A47C 1/024 297/284.4
2015/0001902 A1 * 1/2015 Ellington ..... A47C 1/023 297/353
2015/0108809 A1 4/2015 Romero
2015/0164227 A1 * 6/2015 Battey ..... A47C 1/032 297/284.4
2015/0272334 A1 * 10/2015 Gloeckl ..... A47C 7/443 297/284.7
2016/0037931 A1 * 2/2016 Wu ..... A47C 7/402 297/353

* cited by examiner

CHAIR BACK WITH HEIGHT AND LUMBAR ADJUSTMENT

BACKGROUND

The present disclosure generally relates to an office chair. More specifically, the present disclosure relates to an office chair that allows for the vertical height adjustment of the chair back and provides adjustable lumbar support.

Presently, many different types of office chairs exist that allow the chair back to be adjusted and to recline. Additionally, many different types of office chairs exist that include some type of adjustable lumbar support.

Although office chairs exist that allow the user to adjust the chair back and modify the amount of lumbar support, most of these office chairs include complex mechanical linkages and do not provide for ease of adjustment. The complex arrangement and lumbar support increases the cost of manufacturing the office chair and increases the cost and time to assemble such a chair.

SUMMARY

The present disclosure generally relates to an office chair in which the vertical height of the chair back from the chair seat can be adjusted and the amount of lumbar support provided by the chair back can also be adjusted by the user.

The chair includes a chair back assembly that is mounted to a base which also includes a seat to support the user. The chair back assembly includes a support bracket that allows the entire chair back assembly to be mounted to a variety of chair bases. The chair back assembly includes a back support yoke that is pivotally connected to the base through the support bracket. The back support yoke extends over a length and includes a pair of spaced lower movement slots and a pair of spaced upper movement slots. A flexible back shell is mounted to the back support yoke and is configured to support a seated user's upper body. The flexible back shell includes a top end that is movable within the pair of spaced upper movement slots while a bottom end of the flexible back shell is movable within the pair of lower movement slots. The user can adjust the height of the chair back by moving the flexible back shell along the back support yoke. During this movement, both the top end and the bottom end of the flexible back shell move in unison along the back support yoke.

The chair back assembly further includes a lumbar adjustment mechanism that is mounted to the back support yoke. The lumbar adjustment mechanism includes an adjustment cable having one end connected to the bottom end of the flexible back shell. When the lumbar adjustment mechanism is operated, the length of the cable is modified to move the bottom end of the flexible back shell either upward or downward within the pair of spaced lower movement slots. In this manner, the user can independently adjust the height of the flexible back shell of the chair back assembly while also adjusting the amount of lumbar support created by the flexible back shell.

In one embodiment of the disclosure, the lumbar adjustment mechanism includes an adjustment shaft that is operable to retract and extend the cable, thereby adjusting the position of the bottom end of the flexible back shell. During this movement of the bottom end of the flexible back shell, the top end of the flexible back shell remains stationary such that the flexible back shell protrudes further outward from the back support yoke.

The chair back assembly further includes a ratchet mechanism that holds the flexible back shell in a desired vertical position. The ratchet mechanism includes a series of spaced ratchet teeth and a pawl that is movable between the ratchet teeth to lock the flexible back shell in a desired vertical position.

BRIEF DESCRIPTION OF THE DRAWINGS

The drawings illustrate the best mode presently contemplated of carrying out the disclosure. In the drawings.

DETAILED DESCRIPTION

Figure 1:
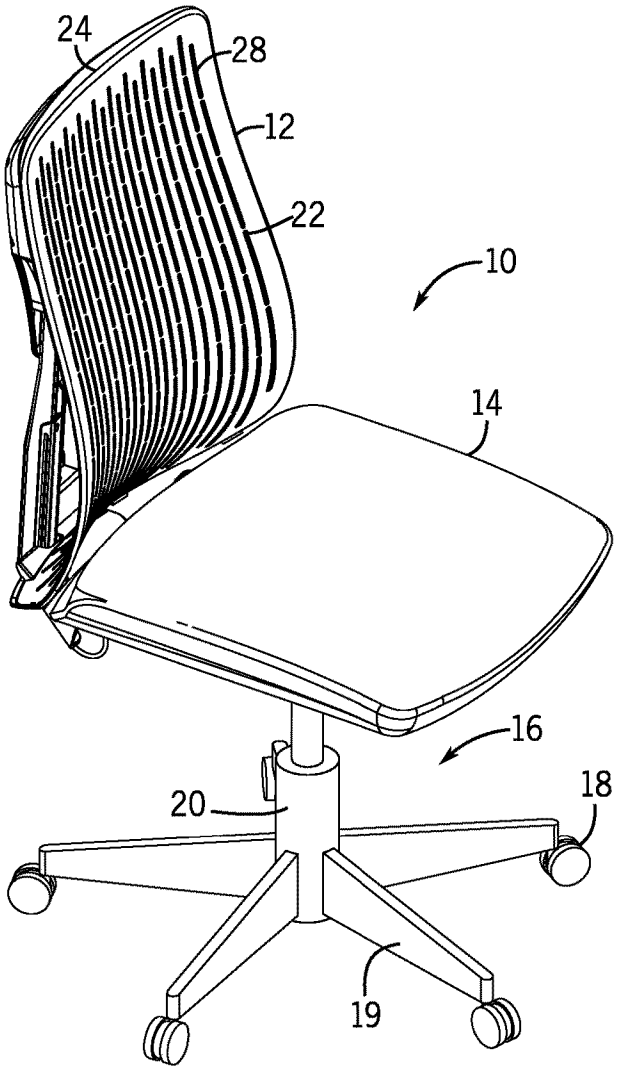
FIG. 1 is a front isometric view of an office chair constructed in accordance with the present disclosure.

FIG. 1 generally illustrates an office chair 10 constructed in accordance with one embodiment of the present disclosure. The office chair 10 generally includes a chair back 12 and a chair seat 14 supported about a pedestal base 16. The pedestal base 16 includes a plurality of castor wheels 18 each mounted to a support leg 19 that allow the base to move the chair as is well known. The pedestal base 16 includes a gas assisted lift mechanism 20 that is operable to adjust the height of the office chair in a conventional manner.

Figure 2:
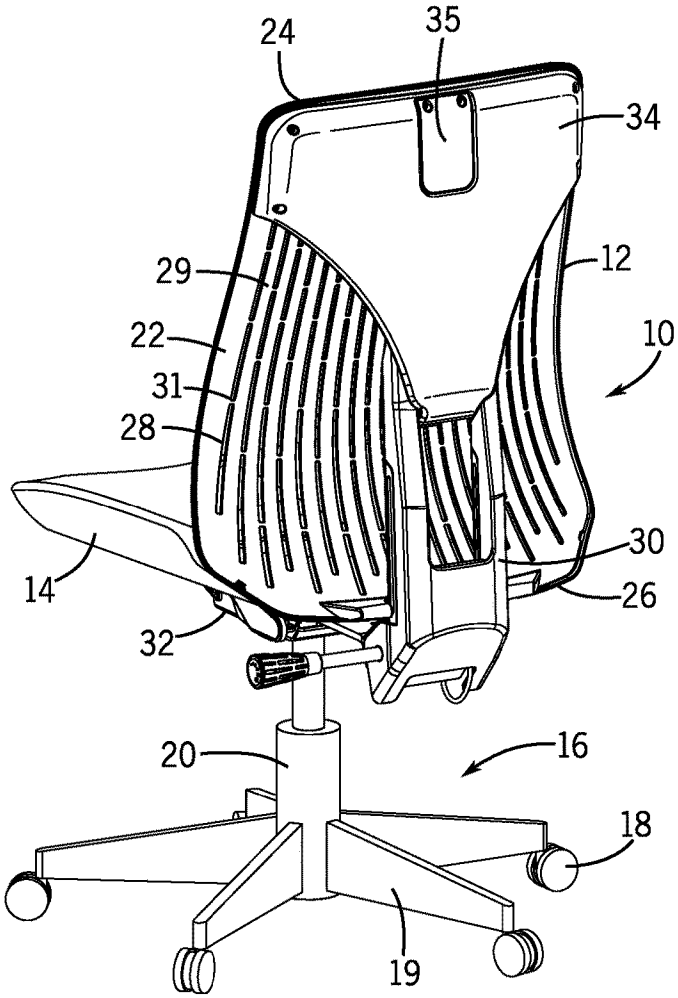
FIG. 2 is a rear isometric view of the office chair illustrating the chair back assembly.

In the embodiment as shown in FIGS. 1 and 2, the office chair 10 does not include chair arms. However, it is contemplated that a pair of chair arms could be incorporated into the office chair 10 while operating within the scope of the present disclosure.

As illustrated in FIGS. 1 and 2, the chair back 12 includes a flexible back shell 22 that extends between a top end 24 and a bottom end 26. In the embodiment illustrated, the flexible back shell 22 is formed from a poly material and includes a series of slots 28 separating a series of slats 29. The flexible back shell 22 provides a cushioned support for the back of a seated user while the slots 28 allow air to pass through the flexible back shell 22. The specific pattern of slots 28 and bridges 31 between the slots is selected to create a type of micro-suspension. When the user sits into the chair back, the flexible back shell 22 responds to the user's shape by each slat 29 flexing a given amount and the adjacent bridges 31 causing the subsequent slats 29 to begin flexing as well. The bridges 31 are positioned in key positions to communicate the flex of the next slat 29.

Figure 9:
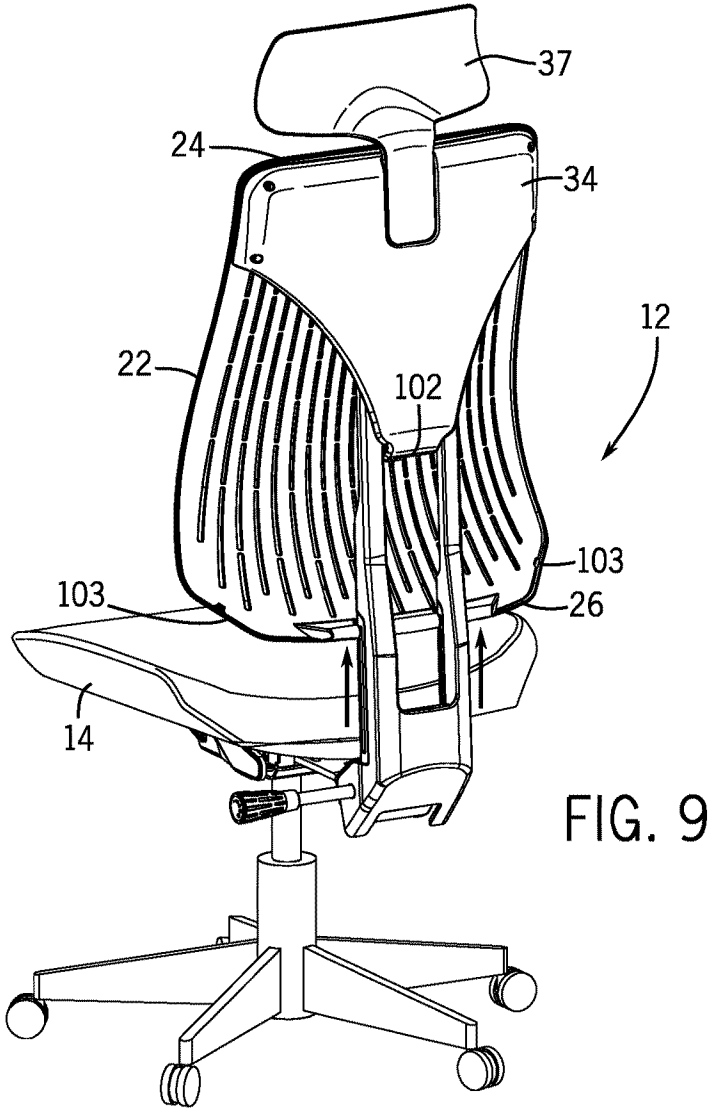
FIG. 9 is a rear isometric view illustrating the vertical height adjustment of the chair back.
Figure 8:
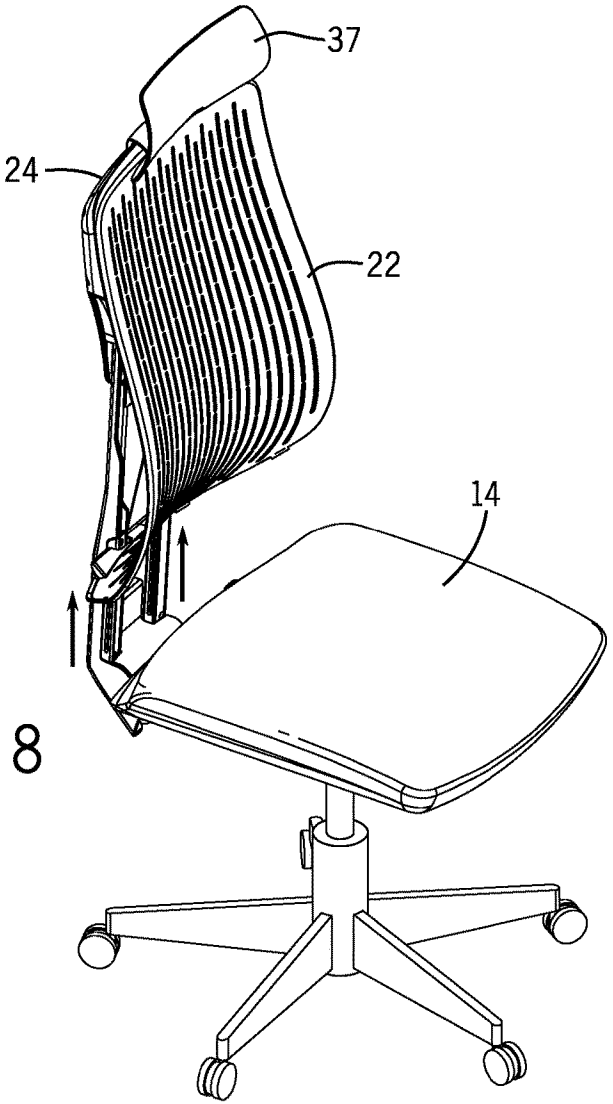
FIG. 8 is a front isometric view showing the vertical height adjustment of the chair back and the inclusion of a headrest.

The chair back 12 further includes a back support yoke 30 that is pivotally mounted to the seat base 32. The back support yoke 30 provides the required support and acts as a guide for the movement of the flexible back shell 22 as described below and for the pivoting action of the chair back 12 relative to the seat 14. As can be seen in FIG. 2, a back shroud 34 is mounted to the top end 24 of the chair back 12 to provide an overall visually appealing appearance for the office chair 10. In addition, the shroud 34 also includes operating components which will be described in great detail below. A logo cover plate 35 is shown as part of the shroud 34 and can be used to present a graphical or textual image. When the logo cover plate 35 is removed, a headrest 37 can be mounted to the chair back as shown in FIGS. 8 and 9. The headrest 37 is an optional feature that can be added or removed from the chair as desired by the user.

Figure 3A:
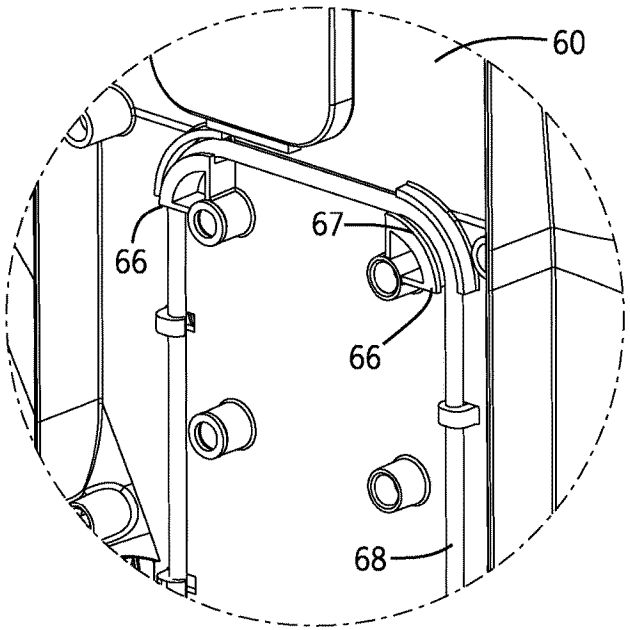
FIG. 3A is a magnified view taken along line 3A-3A in FIG. 3.
Figure 3:
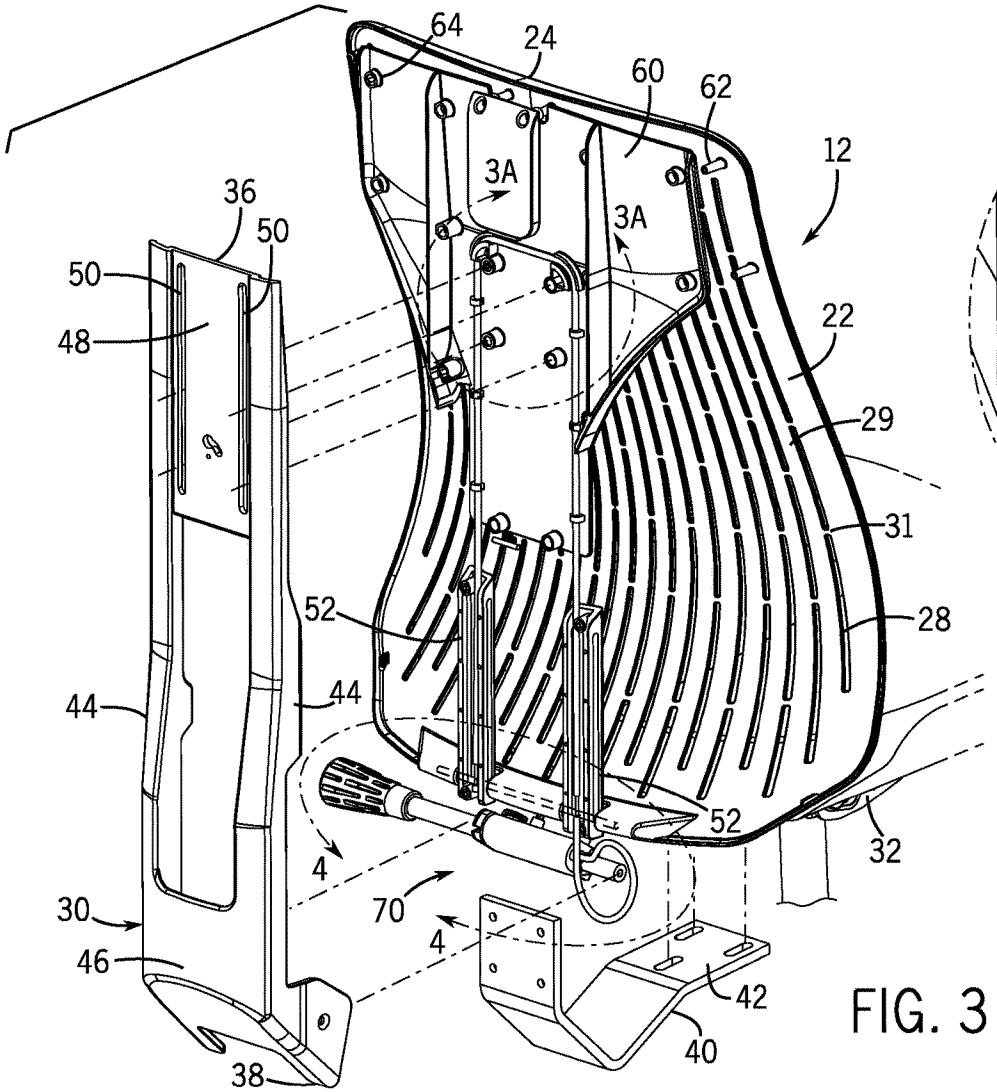
FIG. 3 is a magnified, partially exploded rear view showing the components of the chair back assembly.

FIG. 3 illustrates more details of the operating components of the chair back assembly 12. As illustrated, the back support yoke 30 has an overall length that extends from a top end 36 to a bottom end 38. The bottom end 38 is pivotally connected to a support bracket 40 that has an attachment end 42 securely connected to the seat base 32. Although one type of support bracket 40 is shown in FIG. 3, different types and configurations of the support bracket 40 are contemplated to allow the chair back assembly 12 to be used with a variety of seat bases.

The back support yoke 30 includes a pair of side rails 44 that are spaced from each other and extend upward from a solid connecting portion 46. The top end of each of the side rails 44 are joined to each other by a top plate 48. Top plate 48 includes a pair of spaced upper movement slots 50.

Figure 4:
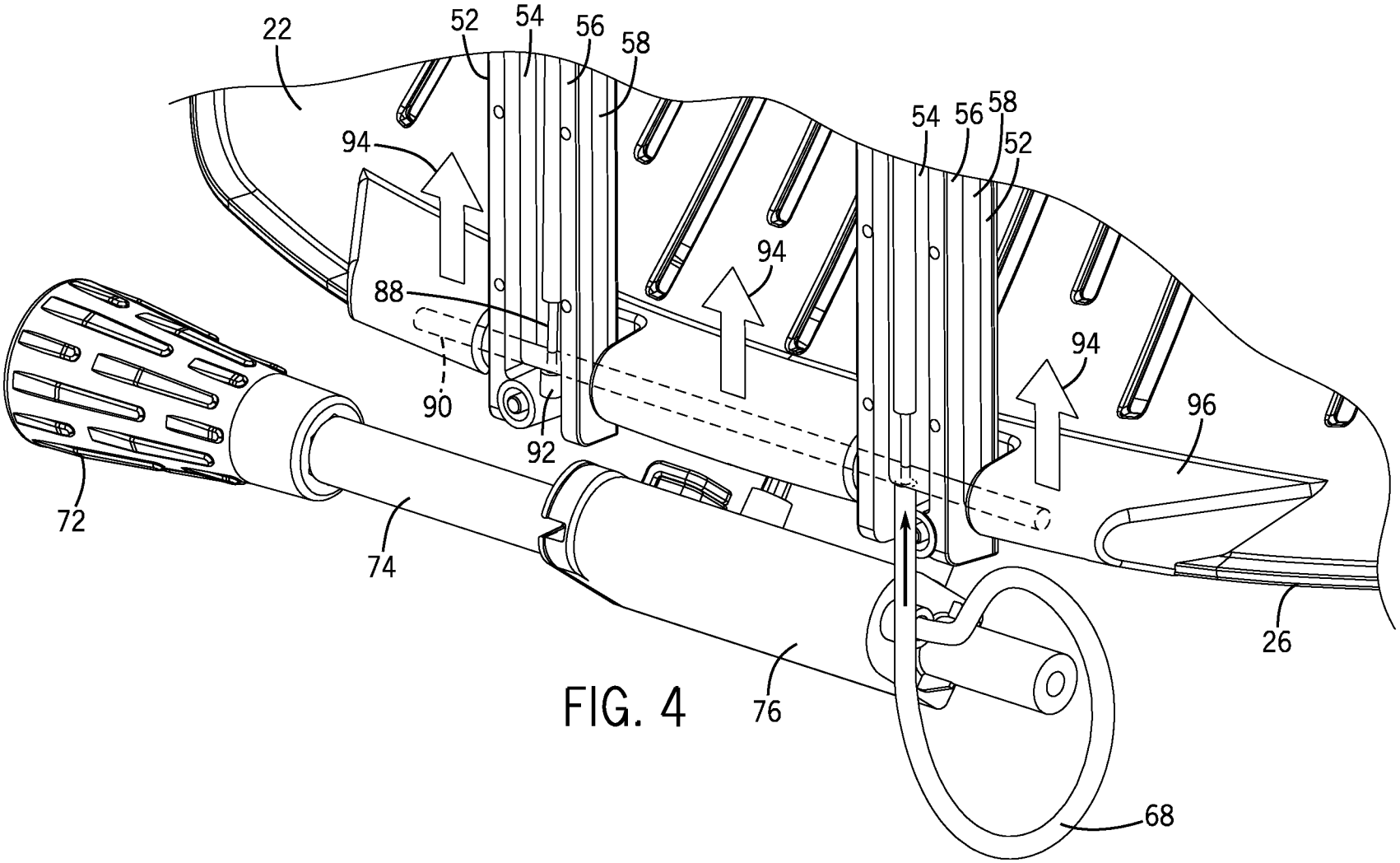
FIG. 4 is a magnified view taken along line 4-4 of FIG. 3 showing the lumbar adjustment mechanism.

Each of the side rails 44 formed as part of the back support yoke 30 receives one of a pair of slot covers 52. Each of the slot covers 52, as shown in FIG. 4, is a U-shaped member having an open internal channel 54 extending between a pair of side walls 56. Each of the side walls 56 includes a lower movement slot 58. Since each of the two slot covers 52 includes a pair of lower movement slots, the pair of slot covers 52 defines a pair of spaced lower movement slots.

Referring back to FIG. 3, each of the slot covers 52 is securely mounted to the back support yoke 30 such that the slot covers 52 form part of the back support yoke 30.

Figure 12:
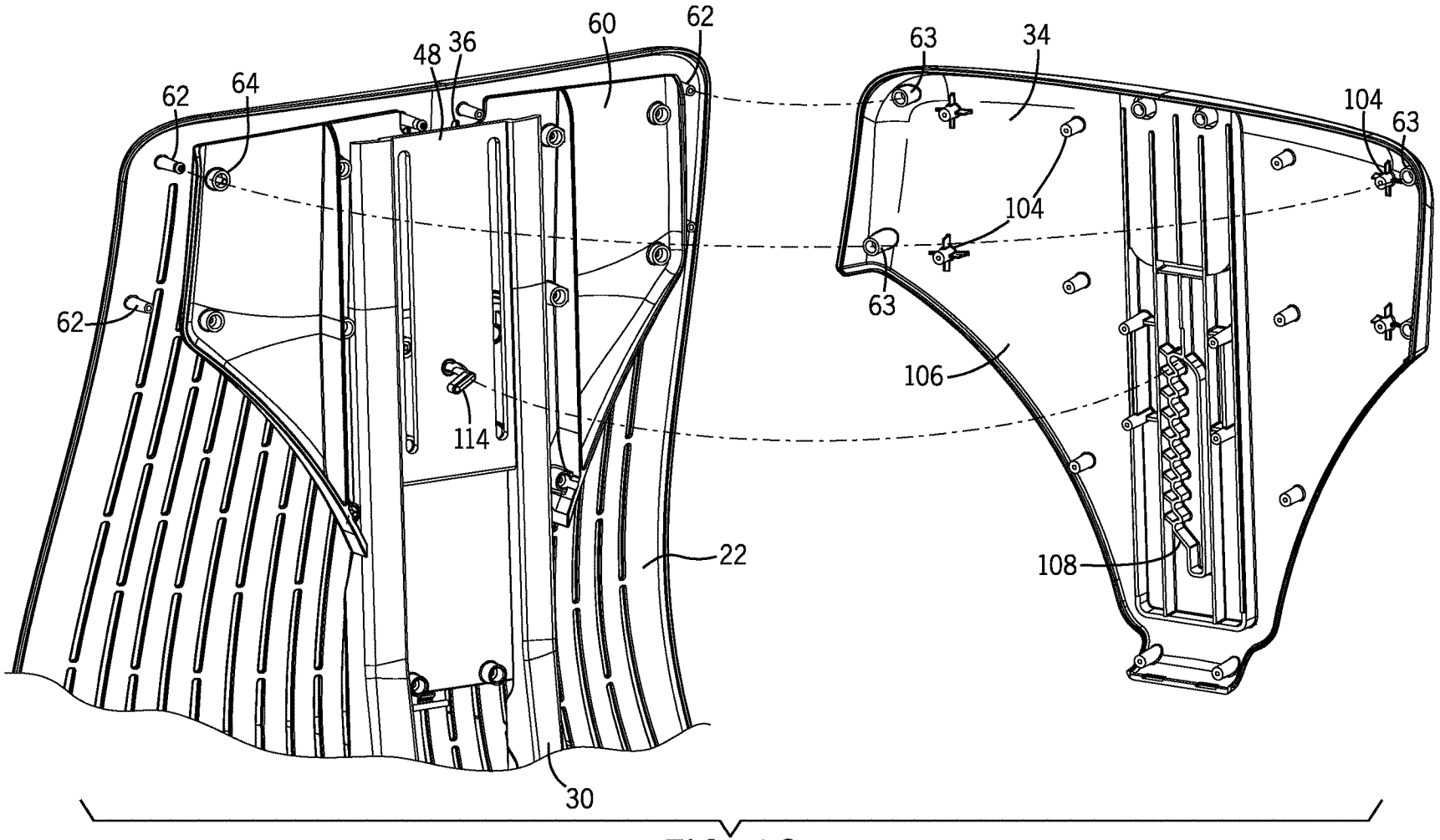
FIG. 12 is a partially exploded, rear view of the top end of the chair back.

As shown in FIGS. 3 and 12, the chair back assembly further includes a shroud liner 60 that is positioned adjacent to the top end 24 of the flexible back shell 22. A series of protrusions 62 formed on the flexible back shell 22 are received within associated receiving bosses 63 formed as part of the shroud 34. The shroud 34 includes standoffs 104 that are received in the bosses 64 of the shroud liner 60. The shroud liner 60 is thus securely attached to shroud 34 while the shroud 34 is connected to both the shroud liner 60 and the flexible back shell 22 such that the shroud liner 60 and shroud 34 surround the top plate 48 of the back support yoke 40 to move vertically along the back support yoke 40 with the movement of the flexible back shell 22.

Referring now to FIG. 3A, the shroud liner 60 includes a pair of cable guides 66 that include a curved cable slot 67 to create a guide for the cable housing 68 which includes an internal wire cable. The cable housing 68 is stationary and passes over each of the cable guides 66, which are a stationary elements molded as part of the shroud liner 60. The cable housing 68 and the pair of cable guides 66 combine to guide the movement of the internal wire cable over the 180 degree transition shown.

Figure 6:
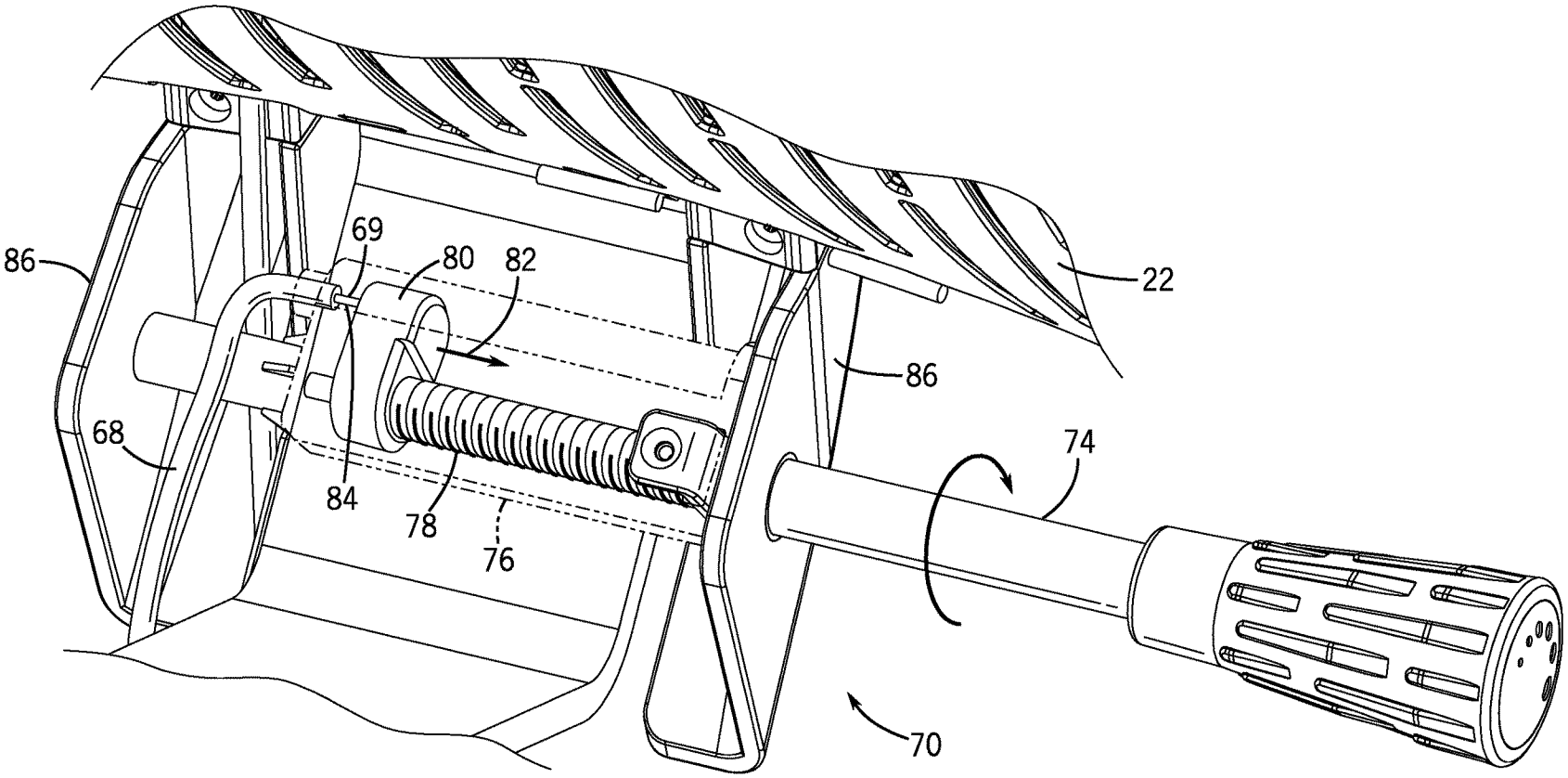
FIG. 6 is a top, isometric view showing the operation of the lumbar adjustment mechanism.

Referring now to FIGS. 3 and 4, the chair back assembly 12 further includes a lumbar adjustment mechanism 70. The lumbar adjustment mechanism 70 allows the operator to adjust the amount of lumbar support provided by the flexible back shell 22. The lumbar adjustment mechanism 70 includes an adjustment handle 72 that is mounted to a shaft 74. The shaft 74 extends into a body 76. As shown in FIG. 6, the portion of the shaft 74 contained within the body 76 includes a threaded portion 78. The threaded portion 78 is received within a corresponding threaded bore formed in a movable cable block 80. As the shaft 74 is rotated, as shown by the arrow in FIG. 6, the threaded interaction between the threaded portion 78 and the block 80 causes the block to move in the direction shown by arrow 82. The block 80 is securely connected to a first end 84 of the wire cable 69 that moves within the cable housing 68. Thus, when the block 80 moves in the direction shown by arrow 82, the cable 69 is pulled into the interior of the body 76. The body 76 is securely mounted between a pair of brackets 86 such that the entire lumbar adjustment mechanism 70 is securely held in place.

Figure 5:
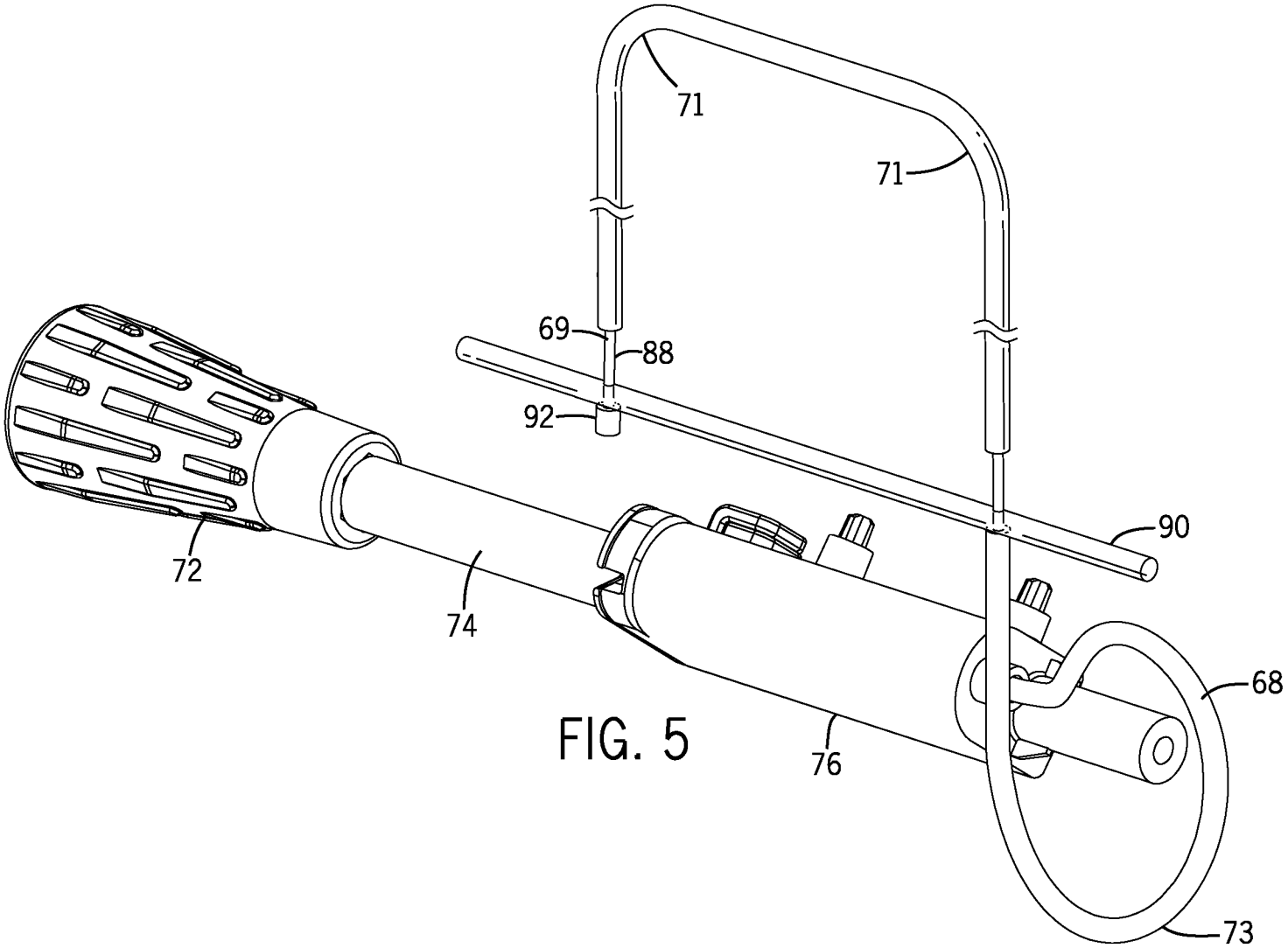
FIG. 5 is a view showing the lumbar adjustment mechanism.

Referring now to FIG. 5, the cable housing 68 extends out of the body 76 and creates a loop 73. The cable housing 68 and the internal cable 69 extend over and around the pair of cable guides 66, shown in FIG. 3A, and located at the transition points 71. A second end 88 of the adjustment cable 69 passes through a connecting rod 90 and is secured in place by block 92. When the shaft 74 is rotated to retract the first end of the adjustment cable 69, the cable 69 causes the connecting rod 90 to move upward, as illustrated by arrows 94 in FIG. 4. As illustrated in FIG. 4, the connecting rod 90 is received within a mounting flange 96 formed as part of the flexible back shell 22 at the bottom end 26 of the flexible back shell 22. The connecting rod 90 extends through the lower mounting slots 58 formed in each of the pair of spaced slot covers 52 such that the connecting rod 90, and thus the bottom end 26 of the flexible back shell 22, is vertically movable within the lower mounting slot 58, as best shown in FIG. 7.

Figure 7:
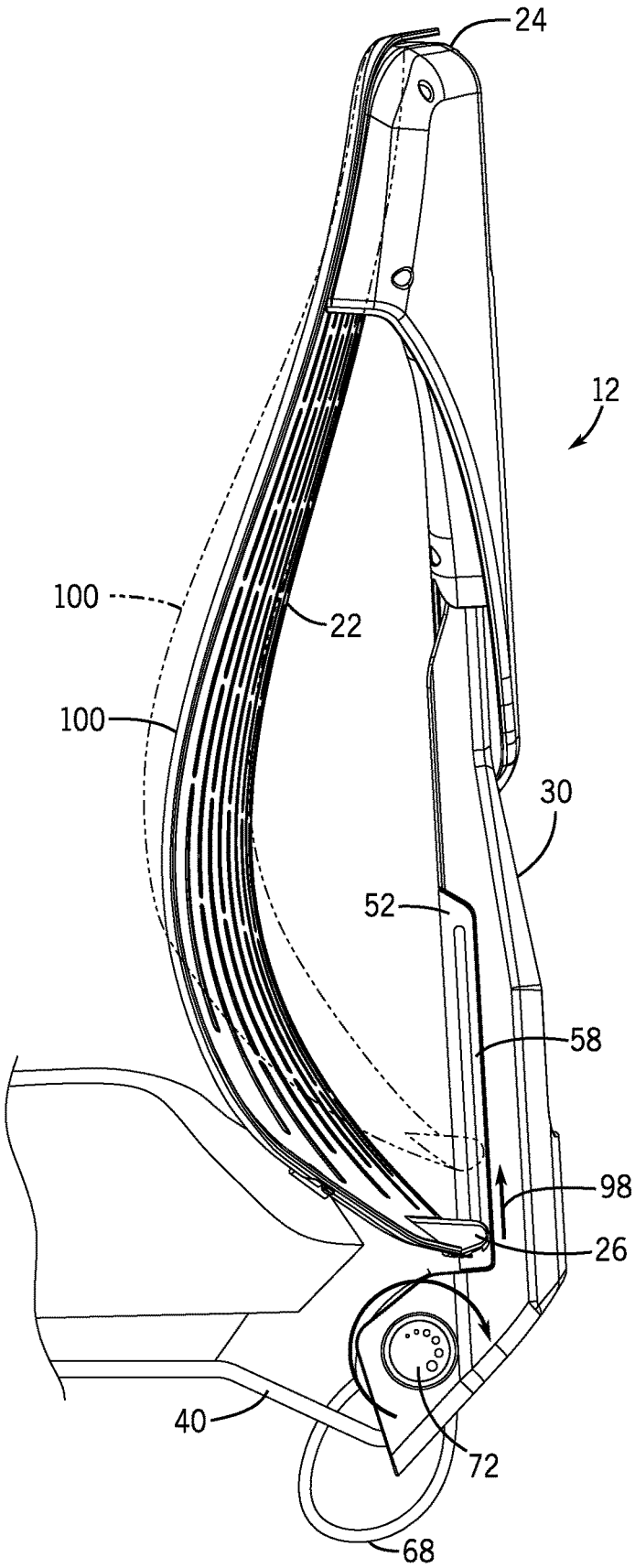
FIG. 7 is a side view showing the movement of the bottom end of the flexible back shell to adjust the amount of protrusion of the flexible back shell.

As can be understood in FIG. 7, when the handle 72 is rotated in the clockwise direction illustrated, the cable 69 is retracted into the lumbar adjustment mechanism, which shortens the length of the adjustment cable 69. As the length of the adjustment cable shortens, the bottom end 26 of the flexible back shell 22 is drawn upward, as illustrated by arrow 98. The upward movement of the bottom end 26 causes the outer surface 100 of the flexible back shell 22 to protrude outward further from the back support yoke 30, as shown by the dashed lines in FIG. 7. In this manner, the amount of lumbar support created by the flexible back shell 22 can be increased.

Alternatively, if the handle 72 shown in FIG. 7 is rotated in the counterclockwise direction, the length of the adjustment cable 69 increases, thereby causing the bottom end 26 of the flexible back shell 22 to move downward within the lower mounting slots 58. This downward movement decreases the protrusion of the outer surface 100, thereby reducing the amount of lumbar support provided by the flexible back shell 22. As can be understood in FIG. 7, when the bottom end 26 of the flexible back shell 22 moves vertically within the pair of lower movement slots 58, the top end 24 of the chair back assembly 12 remains stationary. Thus, the use of the lumbar adjustment mechanism 70 only moves the bottom end 26 of the flexible back shell 22 without adjusting the vertical position of the top end 24 of the chair back.

In addition to being able to adjust the lumbar support, the chair back assembly 12 allows the entire height of the chair back to be adjusted vertically, as shown in FIGS. 8-11. A user, by grasping a handle portion 102 formed as part of the shroud 34 or by grasping the lower edges 103 of the flexible back shell 22, can pull up on the chair back to move the entire flexible back shell 22 in the direction shown by arrows in FIGS. 8 and 9. The upward movement causes both the top end 24 and the bottom end 26 of the flexible back shell 22 to move upward in unison. This movement does not affect the amount of lumbar support and instead moves the entire back shell 22.

Figure 10:
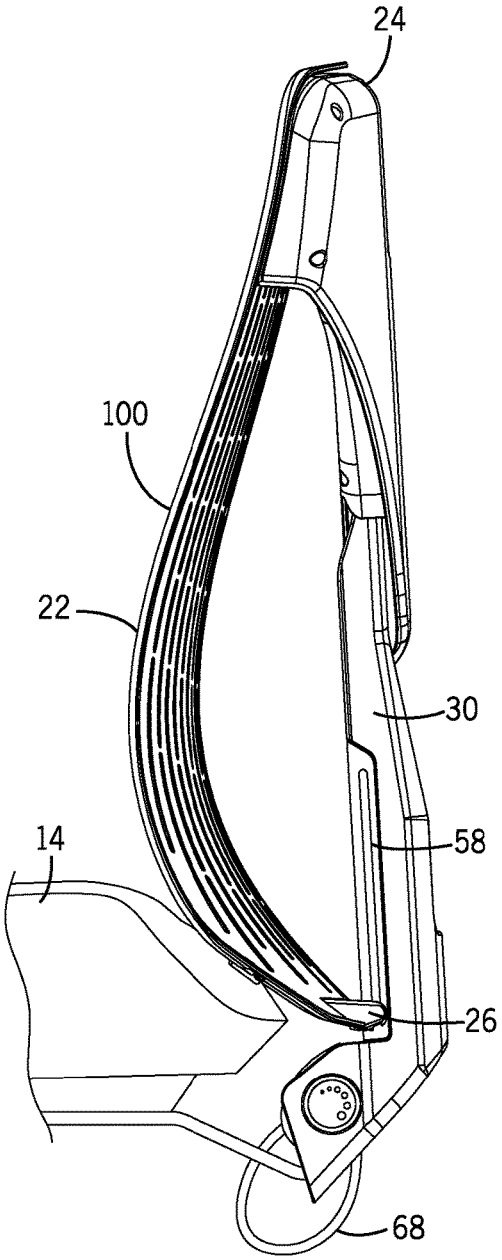
FIG. 10 is a side view showing the chair back in its lowest position.

FIG. 10 illustrates the chair back, and specifically the back shell 22 in its lowermost position. In this lowermost position, the bottom end 26 of the back shell 22 is positioned near the bottom of the lowermost mounting slots 58 while the top end 24 is positioned at its vertically lowest position relative to the stationary back support yoke 30. In the lowermost position, the user can operate the lumbar adjustment mechanism 70 to adjust the lumbar support, as previously discussed.

Figure 11:
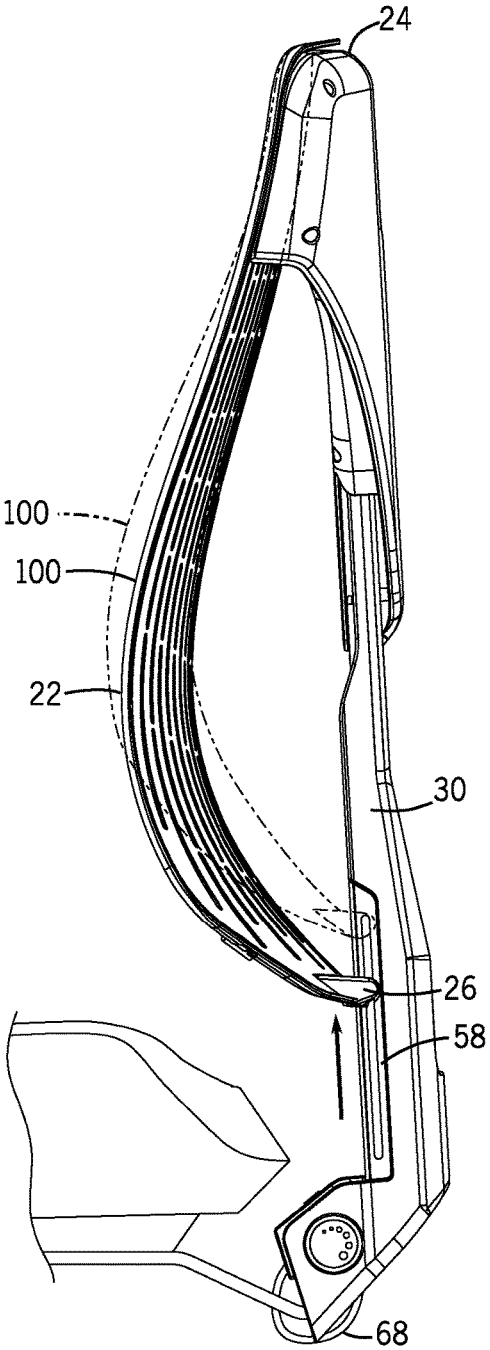
FIG. 11 is a side view showing the movement of the chair back to its uppermost position.

FIG. 11 illustrates the chair back, and specifically the flexible back shell 22, in its uppermost vertical position. In this position, the bottom end 26 of the flexible back shell 22 is located about one inch below the top end of the lower mounting slot 58. In addition, the top end 24 is extended as vertically far as possible along the length of the back support yoke 30. As can be understood in the comparison between FIGS. 10 and 11, during this vertical movement, the outer surface 100 of the flexible back shell 22 does not extend any further from the back support yoke 30. In addition, during this movement, the length of the cable 69 is reduced since, as described in FIG. 4, the second end 88 of the support cable 69 is securely attached to the bottom end 26 of the chair back. In the uppermost position shown in FIG. 11, the lumbar adjustment mechanism 70 can still be operated to move the bottom end 26 upward approximately one inch to increase the lumbar support, as shown by the dashed lines in FIG. 11.

The movement of the chair back vertically as illustrated in FIGS. 10 and 11 is controlled by a ratchet mechanism positioned between the shroud liner 60 and the back shroud 34, as best illustrated in FIG. 12. As shown in FIG. 12, the shroud 34 includes a plurality of standoffs 104 that are each received in one of the bosses 64 formed as part of the shroud liner 60. The interaction between the standoffs 104 and bosses 64 create a gap between the inner surface 106 of the shroud 34 and the shroud liner 60. The space created receives the top end 36 of the back support yoke 30 such that the top plate 48 is sandwiched between the shroud liner 60 and the shroud 34.

The inner surface 106 of the shroud 34 defines a molded movement guide 108. As can be seen in FIG. 13A, the movement guide 108 includes a plurality of spaced ratchet teeth 110 that are positioned opposite an open movement channel 112. Referring back to FIG. 12, a pawl 114 extends through the top plate 48 and is received within the recessed portion of the movement guide 108.

Figure 13B:
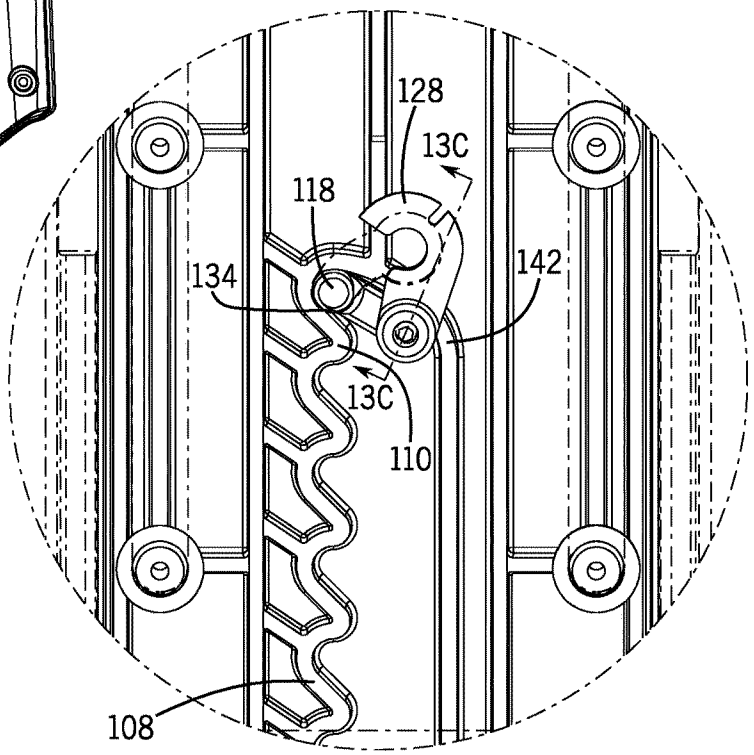
FIG. 13B is a magnified view taken along line 13B-13B of FIG. 13A.
Figure 13A:
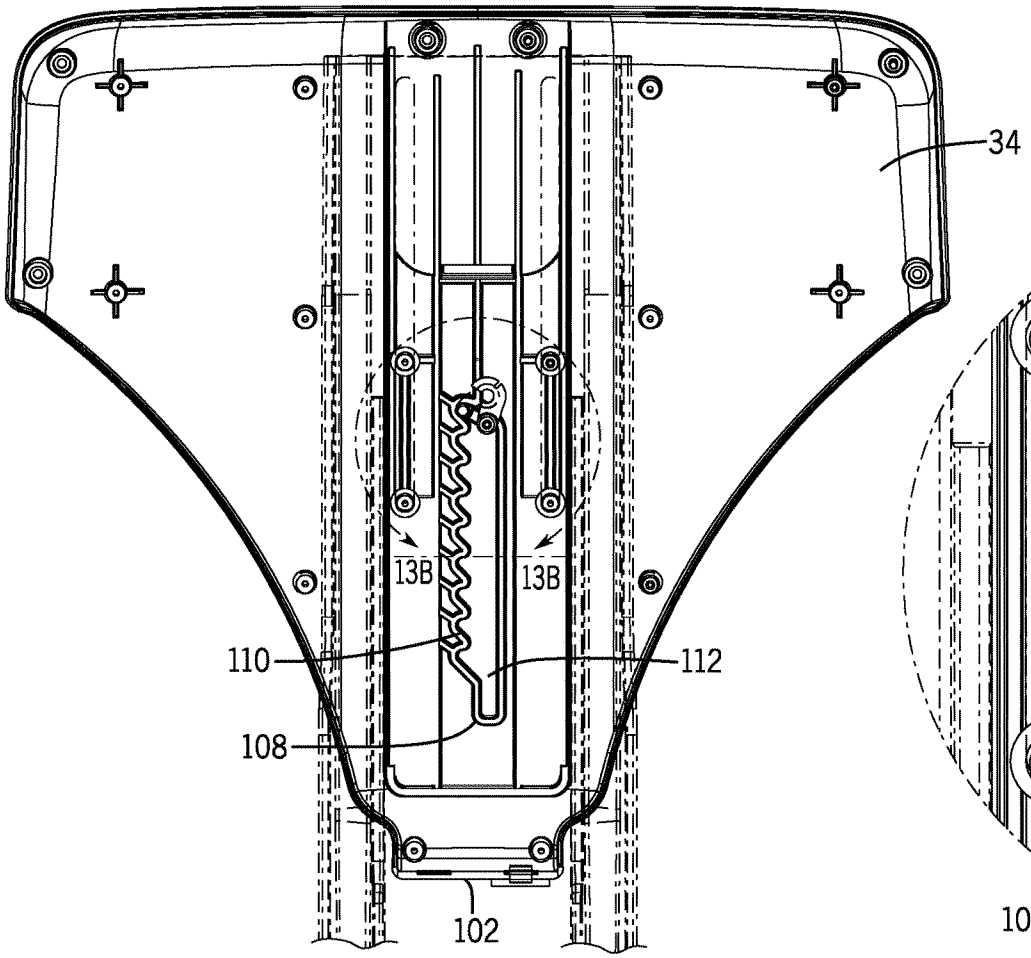
FIG. 13A is a back view showing the ratchet mechanism with the top end of the chair back is in its lowest position.
Figure 13C:
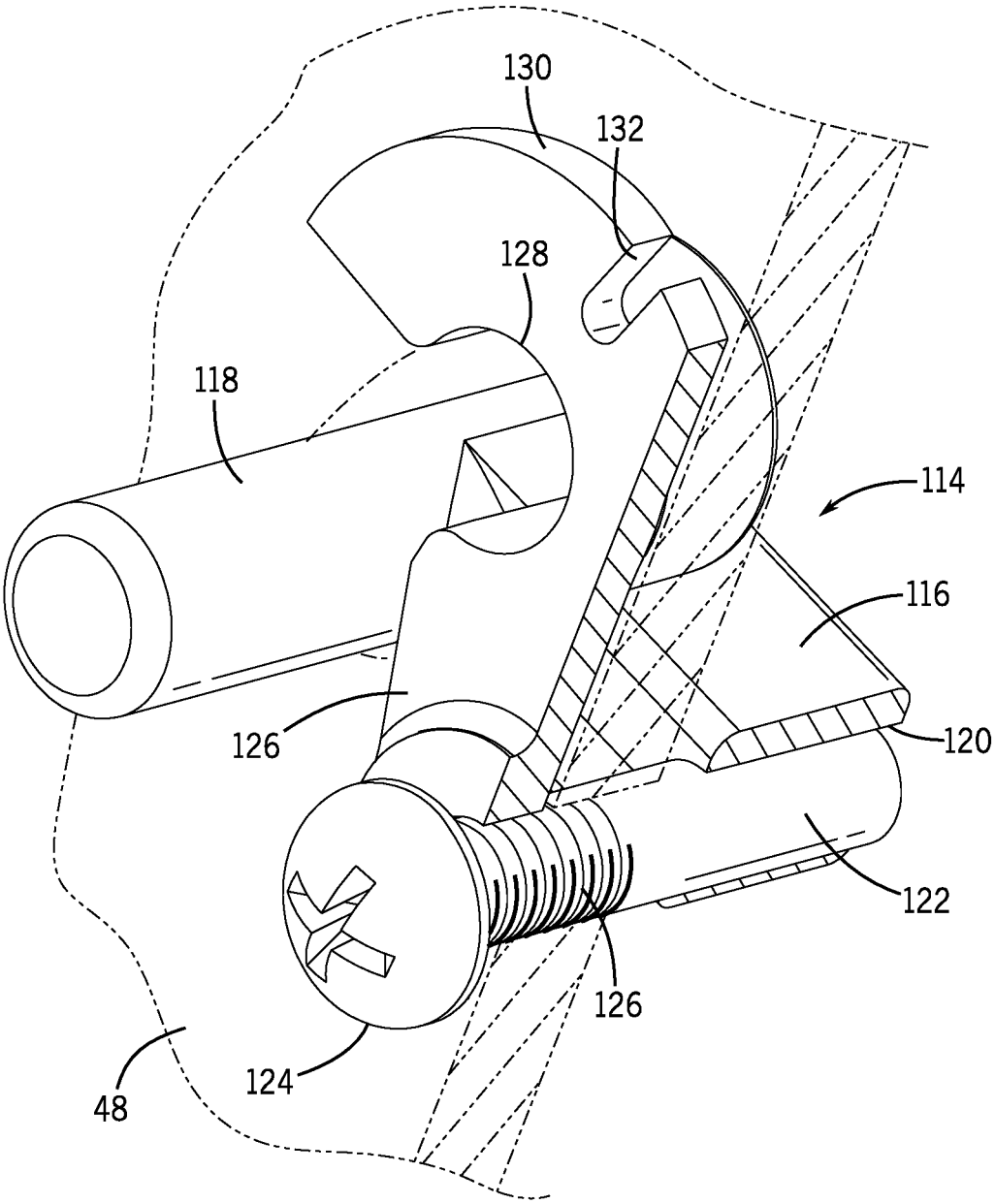
FIG. 13C is a section view taken along line 13C-13C of FIG. 13B.

The pawl 114 is shown in FIG. 13C and includes an attachment portion 116 and an engagement portion 118 that are connected to each other at a right angle. The attachment portion 116 includes a cavity 120 that receives an unthreaded portion 122 of the mounting screw 124. A first portion 126 of the screw shaft includes threads such that the screw 124 is secured to the top plate 48. As illustrated in FIG. 13C, a pawl catch 126 is securely attached to the top plate 48 by the screw 124. The catch 126 includes a receiving cavity 128 that is sized slightly larger than the outer diameter of the engagement portion 118 of the pawl 114. An outer surface 130 of the catch 126 includes an expansion slot 132 that allows the catch to expand and increase the size of the cavity 128 to receive the engagement portion 118.

Referring back to FIGS. 13A and 13B, when the chair back, and specifically the shroud 34, are in their lowermost position, the engagement portion 118 is received within the uppermost recess 134 slightly above the uppermost ratchet tooth 110. In this position, the engagement portion 118 is positioned outside of the catch 128.

Figure 14:
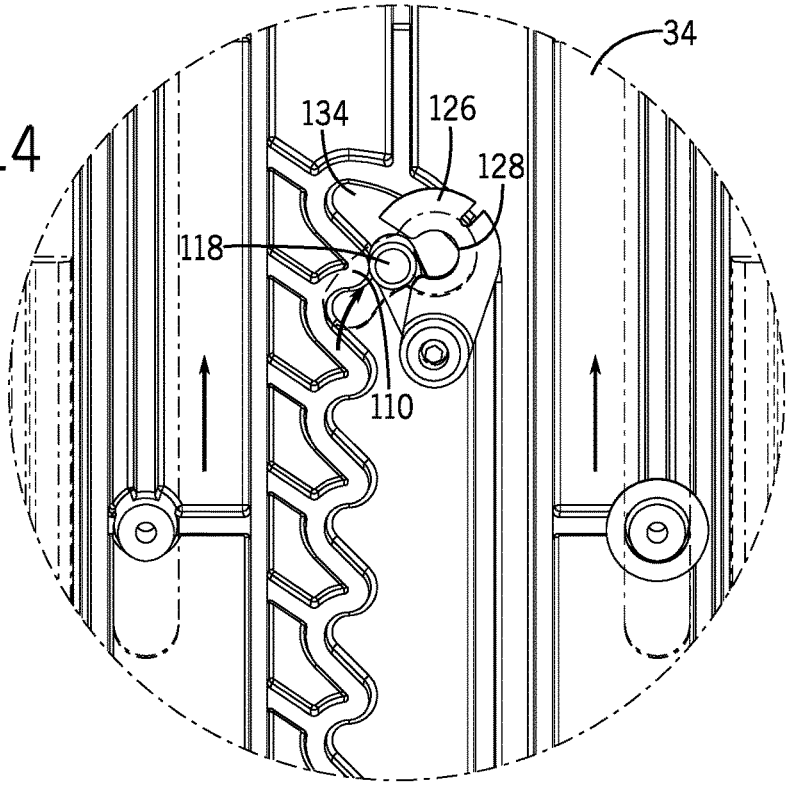
FIG. 14 is a partial, magnified view showing operation of the pawl and latch assembly.
Figure 15:
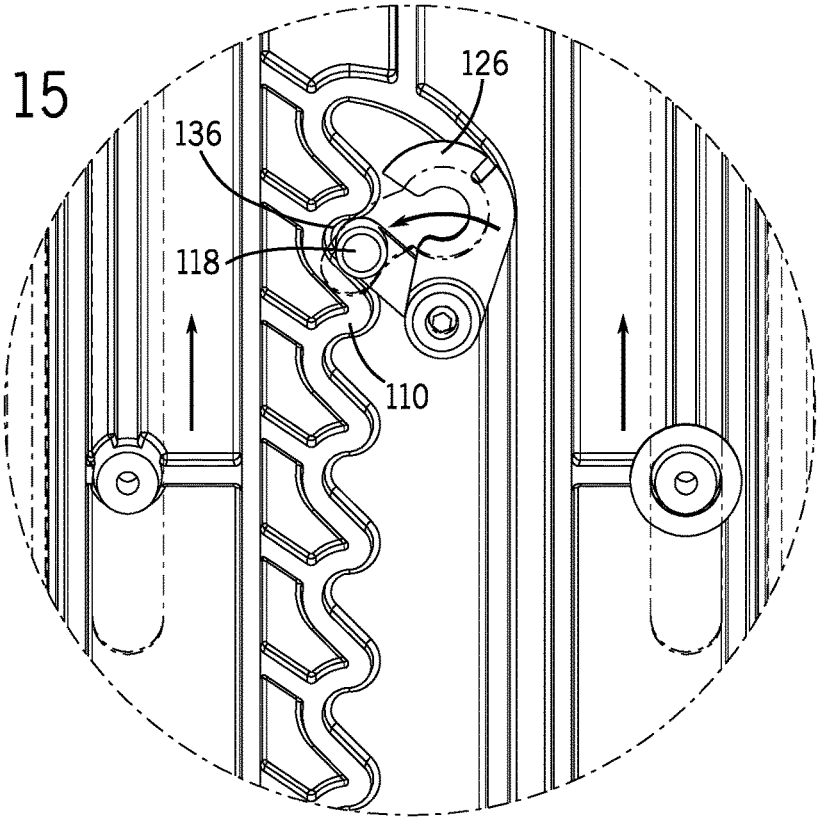
FIG. 15 is a view similar to FIG. 14 upon movement of the chair back.

When the user desires to raise the chair back, the user grasps either the lower edges of the flexible back shell 22 or the handle portion 102 and exerts an upward force. As shown in FIG. 14, when the chair back and specifically the shroud 34 begin to move upward, the engagement portion 118 moves out of the uppermost recess 134 and travels over the first ratchet tooth 110. This movement causes the engagement portion 118 to move toward the receiving cavity 128 of the catch 126. Continuous movement of the chair back upward, as shown in FIG. 15, causes the engagement portion 118 to move into the second recess 136 which is slightly above the second ratchet tooth 110. This process continues until the user has positioned the chair back at the desired height. The orientation and configuration of the pawl 114 and catch 126 prevent the user from moving the chair back downward.

Figure 16:
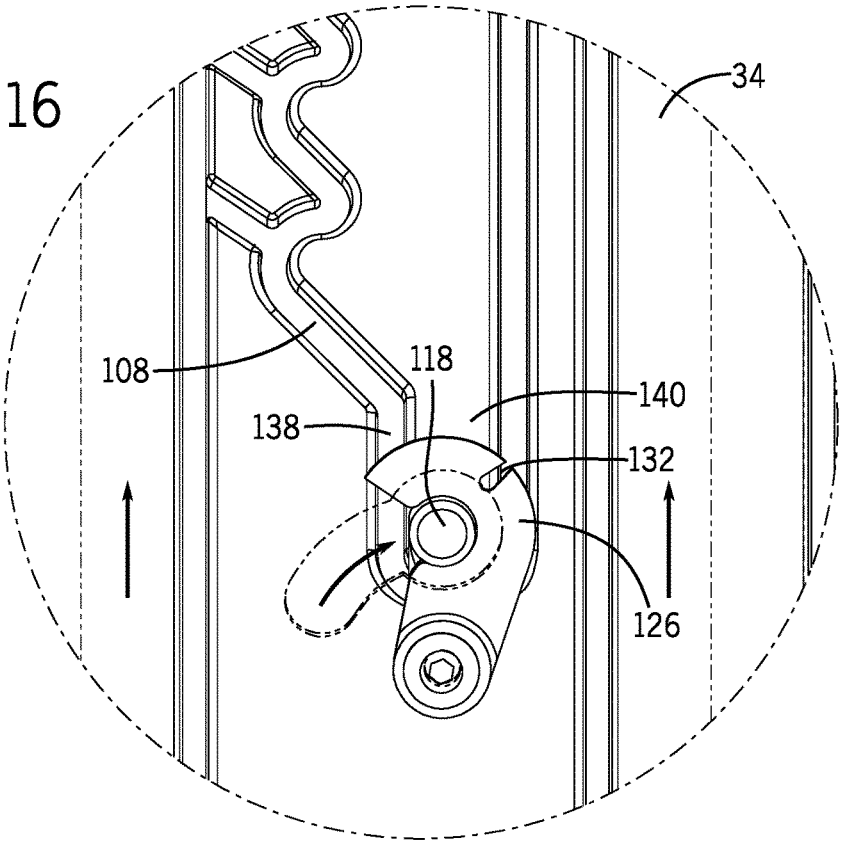
FIG. 16 is a view showing the pawl and latch in the uppermost position of the chair back.
Figure 17:
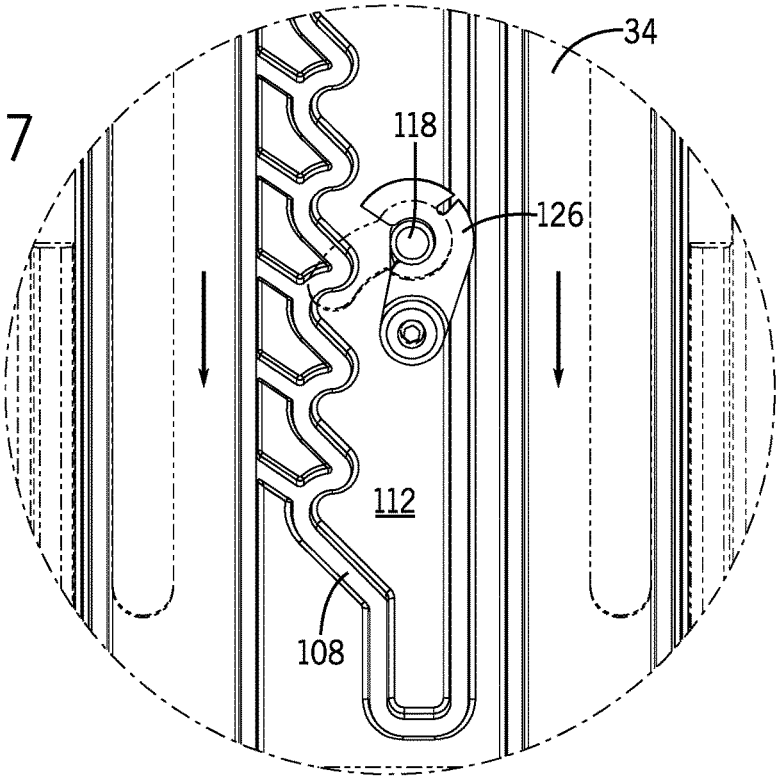
FIG. 17 is a view similar to FIG. 16 showing the movement of the chair back.

If the user desires to lower the chair back, the user must first raise the chair back to its uppermost position, which is shown in FIG. 16. In this uppermost position, the pawl enters into the locking portion 138 of the movement guide 108. The locking portion 138 includes a reduced width channel 140 that causes the engagement portion 118 to be pressed into the cavity formed within the catch 126. As shown in FIG. 16, the slot 132 is compressed and the engagement portion 118 is held securely in place. Once in this locked position, the user can lower the chair back, and specifically the shroud 34, as illustrated in FIG. 17. Since the engagement portion 118 is locked within the catch 126, the engagement portion freely travels within the movement channel 112 formed as part of the movement guide 108.

Once the chair back reaches its lowest position, as shown in FIG. 13B, the top end 142 of the movement guide 108 causes the engagement portion 118 to become disengaged from the catch 128. In this manner, the ratchet mechanism allows the chair back to be raised in predetermined height intervals until the chair back reaches its highest position. If the user desires to lower the chair back, the user raises the chair back further causing the engagement portion of the pawl to be received within the catch 126. Once engaged and received as shown in FIG. 16, the chair back can be lowered as shown in FIG. 17.

As can be understood by the above description and drawings, the chair back mechanism of the present disclosure allows the height of the chair back to be adjusted. In addition, the lumbar support provided by the chair back can be modified through a lumbar adjustment mechanism.

I claim:

1. A chair back assembly for use with a chair including a base and a seat supported on the base, the chair back assembly comprising:

a back support yoke pivotably connected to the base, the back support yoke having a length and including a pair of spaced lower movement slots and a pair of spaced upper movement slots;

a flexible back shell configured to support a seated user's upper body, the flexible back shell including a top end movable within the pair of spaced upper movement slots and a bottom end movable within the pair of spaced lower movement slots, wherein the position of both the top end and the bottom end of the flexible back shell along the length of the back support yoke are adjustable in unison; and a lumbar adjustment mechanism mounted to the back support yoke and operatively connected to the bottom end of the flexible back shell, wherein the lumbar adjustment mechanism is operable to adjust the position of the bottom end of the flexible back shell.

2. The chair back assembly of claim 1 wherein the movement of the bottom end of the flexible back shell within the lower movement slots modifies an amount the flexible back shell protrudes forwardly from the back support yoke.

3. The chair back assembly of claim 2 wherein the lumbar adjustment mechanism includes a cable having a first end connected to the bottom end of the flexible back shell.

4. The chair back assembly of claim 3 wherein a second end of the cable is connected to an adjustment shaft operable to retract and extend the cable to adjust the position of the bottom end of the flexible back shell.

5. The chair back assembly of claim 4 wherein the ratchet mechanism includes a series of ratchet teeth formed on the back shroud and a pawl movable along the series of ratchet teeth.

6. The chair back assembly of claim 5 wherein the ratchet mechanism includes a catch having an internal cavity sized to receive and retain the pawl.

7. The chair back assembly of claim 1 further comprising:

a back shroud connected to the upper end of the flexible back shell;

a shroud liner connected to the back shroud, wherein the back support yoke is positioned between the shroud liner and the back shroud; and a ratchet mechanism positioned to restrict the movement of the top end of the flexible back shell along the length of the back support yoke.

8. The chair back assembly of claim 1 wherein the back support yoke includes a pair of spaced side rails and a top plate connecting the pair of side rails, wherein the top plate includes the pair of upper movement slots.

9. A chair, comprising:

a base;

a seat supported on the base; and a chair back assembly, comprising:

a back support yoke pivotably connected to the base, the back support yoke having a length and including a pair of spaced lower movement slots and a pair of spaced upper movement slots;

a flexible back shell configured to support a seated user's upper body, the flexible back shell including a top end movable within the pair of spaced upper movement slots and a bottom end movable within the pair of spaced lower movement slots, wherein the position both the top end and the bottom end of the flexible back shell along the length of the back support yoke are adjustable in unison; and a lumbar adjustment mechanism mounted to the back support yoke and operatively connected to the bottom end of the flexible back shell, wherein the lumbar adjustment mechanism is operable to adjust the position of the bottom end of the flexible back shell.

10. The chair back assembly of claim 9 wherein the movement of the bottom end of the flexible back shell within the lower movement slots modifies an amount the flexible back shell protrudes forwardly from the back support yoke.

11. The chair back assembly of claim 10 wherein the lumbar adjustment mechanism includes a cable having a first end connected to the bottom end of the flexible back shell.

12. The chair back assembly of claim 11 wherein a second end of the cable is connected to an adjustment shaft operable to retract and extend the cable to adjust the position of the bottom end of the flexible back shell.

13. The chair back assembly of claim 9 further comprising:

a back shroud connected to the upper end of the flexible back shell;

a shroud liner connected to the back shroud, wherein the back support yoke is positioned between the shroud liner and the back shroud; and a ratchet mechanism positioned to restrict the movement of the top end of the flexible back shell along the length of the back support yoke.

14. The chair back assembly of claim 13 wherein the ratchet mechanism includes a series of ratchet teeth formed on the back shroud and a pawl movable along the series of ratchet teeth.

15. The chair back assembly of claim 14 wherein the ratchet mechanism includes a catch having an internal cavity sized to receive and retain the pawl.

16. The chair back assembly of claim 9 wherein the back support yoke includes a pair of spaced side rails and a top plate connecting the pair of side rails, wherein the top plate includes the pair of upper movement slots.

17. A chair, comprising:

a base;

a seat supported on the base; and a chair back assembly, comprising:

a back support yoke pivotably connected to the base;

a flexible back shell configured to support a seated user's upper body, the flexible back shell including a top end and a bottom end, wherein the position of both the top end and the bottom end of the flexible back shell along the length of the back support yoke is adjustable in unison; and a lumbar adjustment mechanism mounted to the back support yoke and operatively connected to the bottom end of the flexible back shell, wherein the lumbar adjustment mechanism is operable to adjust the position of the bottom end of the flexible back shell along the length of the back support yoke and relative to the top end.

18. The chair back assembly of claim 17 wherein the movement of the bottom end of the flexible back shell modifies an amount the flexible back shell protrudes forwardly from the back support yoke.

19. The chair back assembly of claim 18 wherein the lumbar adjustment mechanism includes a cable having a first end connected to the bottom end of the flexible back shell and a second end connected to an adjustment shaft operable to retract and extend the cable to adjust the position of the bottom end of the flexible back shell.

20. The chair back assembly of claim 17 further comprising:

a back shroud connected to the upper end of the flexible back shell;

a shroud liner connected to the back shroud, wherein the back support yoke is positioned between the shroud liner and the back shroud; and a ratchet mechanism positioned to restrict the movement of the top end of the flexible back shell along the length of the back support yoke.

* * * * *